United States Patent [19]

Closmann

[11] 4,026,359

[45] May 31, 1977

[54] PRODUCING SHALE OIL BY FLOWING HOT AQUEOUS FLUID ALONG VERTICALLY VARIED PATHS WITHIN LEACHED OIL SHALE

[75] Inventor: Philip J. Closmann, Houston, Tex.

[73] Assignee: Shell Oil Company, Houston, Tex.

[22] Filed: Feb. 6, 1976

[21] Appl. No.: 655,922

[52] U.S. Cl. ..... 166/263; 166/271; 166/272; 166/306; 299/4

[51] Int. Cl.[2] ..... E21B 43/24; E21B 43/26; E21B 43/28

[58] Field of Search ..... 166/263, 251, 252, 271, 166/272, 299, 303, 306; 299/4

[56] References Cited

UNITED STATES PATENTS

| | | | |
|---|---|---|---|
| 2,862,557 | 12/1958 | van Utenhove et al. | 166/263 X |
| 3,361,201 | 1/1968 | Howard | 166/271 X |
| 3,379,246 | 4/1968 | Sklar et al. | 166/263 X |
| 3,379,247 | 4/1968 | Santourian | 166/272 |
| 3,412,794 | 11/1968 | Craighead | 166/272 |
| 3,501,201 | 3/1970 | Closmann et al. | 166/271 X |
| 3,739,851 | 6/1973 | Beard | 166/271 X |
| 3,794,113 | 2/1974 | Strange | 166/263 X |
| 3,822,916 | 7/1974 | Jacoby | 166/299 X |
| 3,967,853 | 7/1976 | Closmann et al. | 166/271 X |

*Primary Examiner*—Stephen J. Novosad
*Assistant Examiner*—George A. Suchfield

[57] ABSTRACT

In producing shale oil from a relatively permeable leached zone within a subterranean oil shale deposit, hot aqueous fluid is flowed between wells along paths which are vertically varied. An initial flow between near-bottom injection and production locations within the leached zone is varied by steps inclusive of producing fluid from a near-top location and injecting fluid into the initial production location.

6 Claims, 3 Drawing Figures

PRODUCING SHALE OIL BY FLOWING HOT AQUEOUS FLUID ALONG VERTICALLY VARIED PATHS WITHIN LEACHED OIL SHALE

BACKGROUND OF THE INVENTION

The invention relates to producing shale oil and related mineral materials from subterranean deposits of oil shale.

Numerous subterranean oil shales are mixed with water-soluble minerals. Such shales comprise substantially impermeable, kerogen-containing, earth formations from which shale oil can be produced by a hot fluid-induced pyrolysis or thermal conversion of the organic solids to fluids. A series of patents typified by the T. N. Beard, A. M. Papadopoulos and R. C. Ueber U.S. Pat. Nos. 3,739,851; 3,741,306; 3,753,594; 3,759,328 and 3,759,574 describe procedures for utilizing the water-soluble minerals in such shales to form rubble-containing caverns and/or leached zones in which the oil shale is exposed to a circulating hot aqueous fluid that converts the kerogen to shale oil while dissolving enough mineral to expand the cavern and expose additional oil shale.

SUMMARY OF THE INVENTION

This invention relates to producing shale oil from a subterranean oil shale deposit having an areally extensive leached zone, which zone contains water-soluble minerals and has been leached to an extent providing significant permeability. At least two wells are opened into fluid communication with the leached zone in horizontally spaced locations. Initially steam is injected into a lower portion of the zone around one well while fluid is produced from a lower portion of the zone around another well. When plugging near the initial production location becomes at least imminent, fluid production is initiated substantially vertically above that location. The production of fluid from the initial production location is terminated and hot aqueous fluid is injected into the initial fluid production location until its effective permeability to injected fluid is increased. Shale oil is recovered from fluid produced from the leached zone.

After the effective permeability in the initial production location has increased, the injection into it and production above it can advantageously be terminated in order to restore the initial pattern of injection and production at near bottom portions of the leached zone. The initial pattern of flow between wells can advantageously be reversed by injecting into the well initially used as a producer and producing from the well initially used as an injector. The flow path that is so established is subsequently varied vertically to the extent required to avoid significant plugging.

DESCRIPTION OF THE INVENTION

As used herein "oil shale" refers to an aggregation of inorganic solids and a predominately hydrocarbon-solvent-insoluble organic-solid material known as "kerogen". "Bitumen" refers to hydrocarbon-solvent-soluble organic material that may be initially present in an oil shale or may be formed by a thermal conversion or pyrolysis of kerogen. "Shale oil" refers to gaseous and/or liquid hydrocarbon materials (which may contain trace amounts of nitrogen, sulfur, oxygen, or the like) that can be obtained by distilling or pyrolyzing or extracting organic materials from an oil shale. "Water-soluble inorganic mineral" refers to halites or carbonates, such as the alkali metal chlorides, bicarbonates or carbonates, which compounds or minerals exhibit a significant solubility (e.g., at least about 10 grams per 100 grams of solvent) in generally neutral aqueous liquids (e.g., those having a pH of from about 5 to 8) and/or heat-sensitive compounds or minerals, such as nahcolite, dawsonite, trona, or the like, which are naturally water-soluble or are thermally converted at relatively mild temperatures (e.g., 500° to 700° F) to materials which are water soluble. The term "water-soluble-mineral-containing subterranean oil shale" refers to an oil shale that contains or is mixed with at least one water-soluble inorganic mineral, in the form of lenses, layers, nodules, finely-divided dispersed particles, or the like. A "cavern" or "cavity" (within an oil shale formation) refers to a relatively solids-free opening or void in which the solids content is less than about 60% (preferably less than about 50%) and substantially all of the solids are fluid-surrounded pieces which are substantially free of the lithostatic pressure caused by the weight of the overlying rocks.

Figure 1:
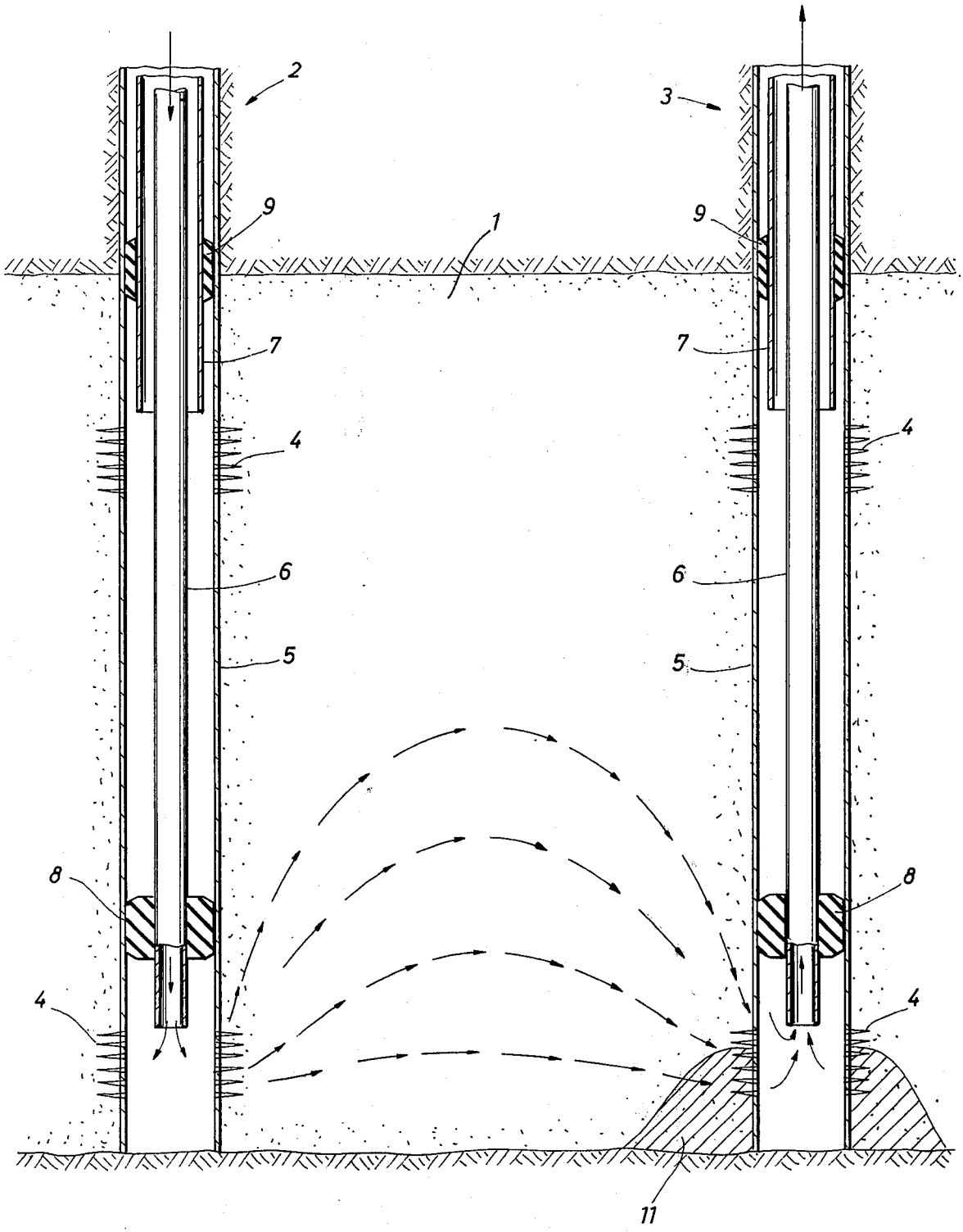
FIGS. 1, 2 and 3 are schematic illustrations of different stages of applying the present invention within a subterranean oil shale deposit.

FIG. 1 shows the initial stage of applying the present process in an areally extensive leached zone within a water-soluble mineral-containing region of a subterranean oil shale deposit. Such a leached zone can be one which has been leached or fractured by substantially any means to an extent sufficient to provide a significant effective permeability to aqueous fluid. For example, the leached zone can be formed by natural events and/or partially or completely formed by man-made events such as hydraulic and/or explosive or nuclear device induced-fracturing or solution mining or the like operations. With such a leached zone the permeability tends to decrease with increases in depth. This is due to the settling of the rock matrix as its structural integrity is weakened by the dissolving of soluble minerals and/or the fracturing of matrix.

Such a leached zone is shown as zone 1 into which wells 2 and 3 have been opened by means of performations 4 through well casings 5. Such wells preferably contain internal conduits 6 and 7 which are surrounded by packers 8 and 9 and are arranged to provide separate conduits that open into fluid communication with, respectively, the upper and lower portions of the leached zone.

As shown by the arrows in FIG. 1, in an initial stage, steam is injected near the bottom of zone 1, around well 2, while fluid is produced from near the bottom of that zone, around well 3. The injected steam tends to rise towards the upper part of the zone, since the steam has a relatively low density and since an injected fluid tends to flow preferentially into regions of greatest permeability. As the steam transfers heat to the components of the leached zone and condenses, the heat pyrolyzes and removes the organic components of the oil shale, and the condensate dissolves soluble minerals. The resulting removal of solids from the upper portions of the formation tends to further increase the permeability in that region. It also further weakens the rock matrix, causing more settling, and releases undissolved fine solids, which tend to move into and plug the initial production location in the lower portion of the leached zone, as indicated by the cross-hatched region 11.

Figure 2:
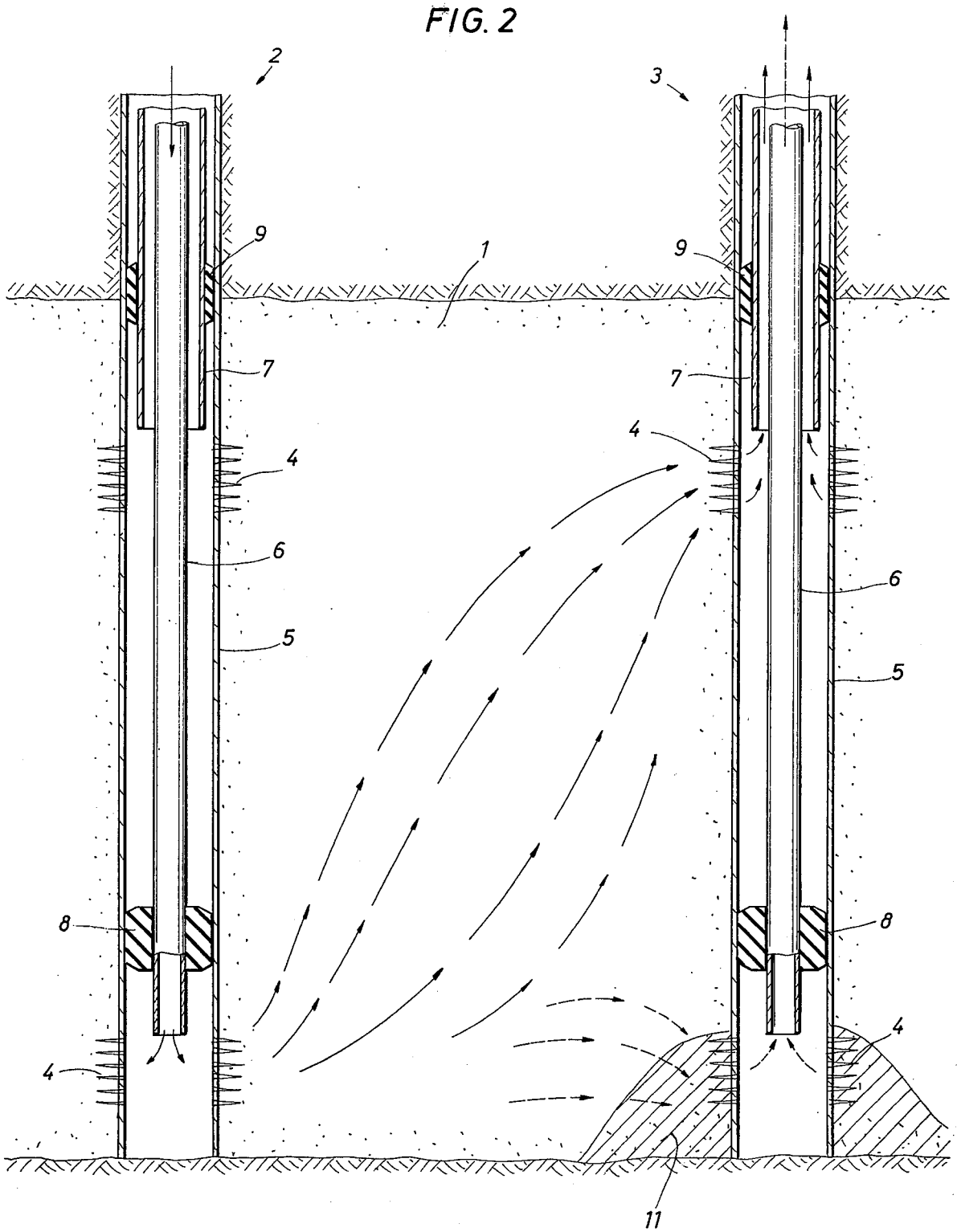

FIG. 2 shows a subsequent stage of the process in which the production of fluid through conduit 6 (from the initial production zone) has been significantly diminished by the increased plugging effect of fines deposited within an expanded zone 11. Production has been initiated (through conduit 7 of well 3) from an upper level within the leached zone.

Figure 3:
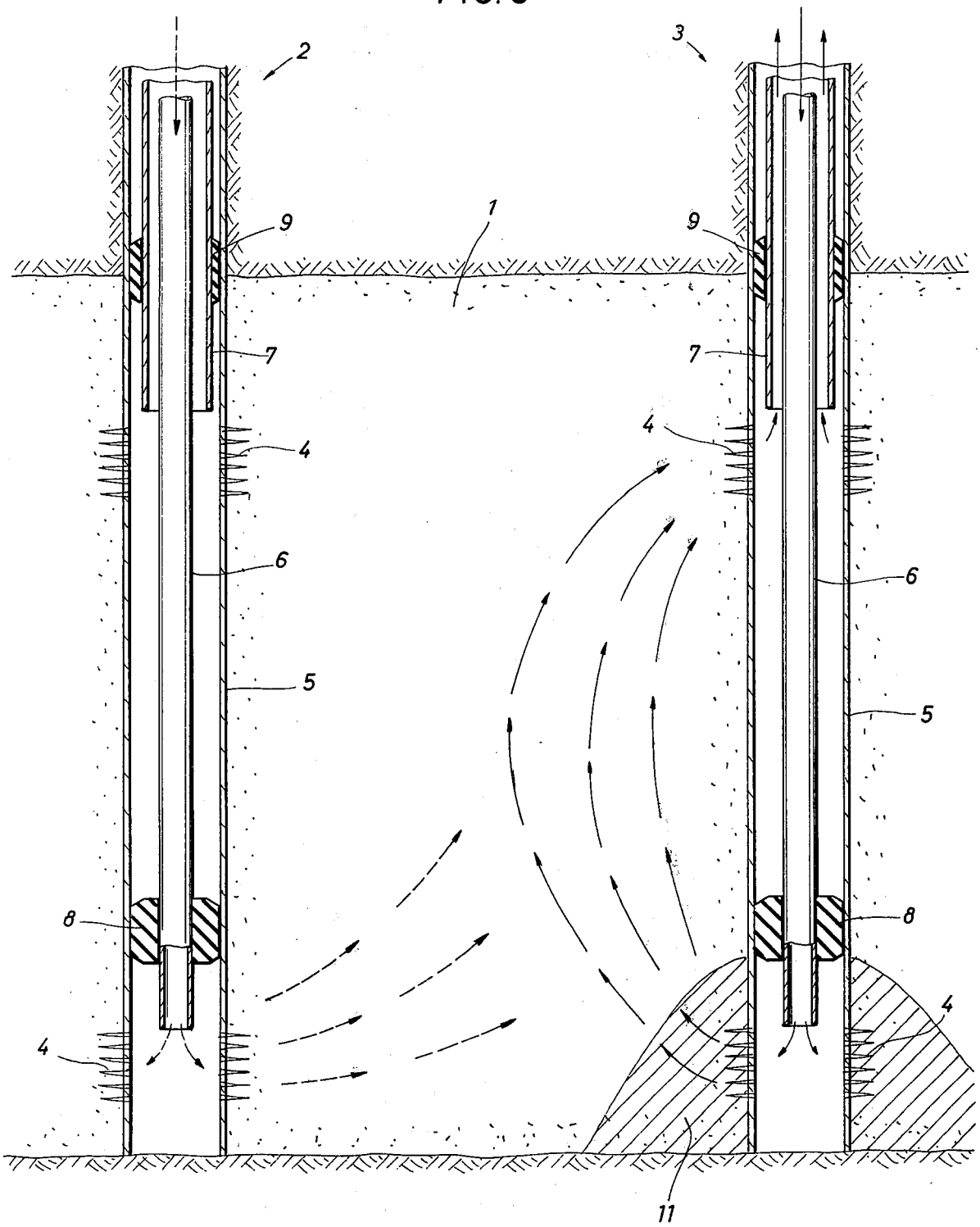

FIG. 3 shows a subsequent stage in which an injection of hot aqueous fluid into the initial production region has been initiated (through conduit 6 of well 3) in order to sweep out and further dissolve or pyrolyze portions of the fines accumulated within region 11. As indicated by the dotted arrows, steam injection (through well 2) can advantageously be maintained into the initial injection region in order to maintain its heat and permeability. The hot fluid which is injected into the initial production location can advantageously be either steam or a hot aqueous liquid, with the latter being preferred at the initial stage of the sweep-out operation. This operation is preferably continued until a significant improvement is attained in the permeability to the fluid being injected. When adequate permeability is attained, the circulation path is preferably varied by returning it to that shown in FIG. 1.

After at least one cycle of successive variations of the flow paths shown in FIGS. 1, 2 and 3, the flow path between the wells is preferably substantially reversed by injecting steam through well 3 while producing fluid through well 2 with the flow paths and conduits arranged as shown in FIG. 1.

In massive oil shale deposits in the Peceance Basin of Colorado leached zones are of natural occurrence. Such natural leached zones often contain relatively thin horizontal stringers of relatively low permeability water-bearing formations called "aquitards". In such a region, the present process can advantageously be applied by establishing and varying circulation paths as shown in FIGS. 1–3 within protions of the leached oil shale formation lying between relatively impermeable stringers, or strata, such as the aquitards and/or underlying or overlying impermeable formations,.

As will be apparent to those skilled in the art, the present process can advantageously be employed by utilizing a pattern of wells. The well pattern can advantageously provide a plurality of injection wells surrounding a producing well in a five-spot or seven-spot, or the like arrangement.

What is claimed is:

1. A process for producing oil from a subterranean oil shale deposit which comprises opening at least two wells into a relatively permeable leached zone within a soluble mineral-containing subterranean deposit of oil shale;

initially injecting steam into a lower portion of the leached zone around at least one well while producing fluid from a lower portion of the leached zone around at least one other well;

when plugging near an initial producing location becomes at least imminent, initiating fluid production substantially vertically above that location;

terminating fluid production from the initial production location;

injecting hot aqueous fluid into the initial fluid production location in a volume sufficient to at least significantly increase the effective permeability to the fluid being injected; and recovering shale oil from fluid produced from the leached zone.

2. The process of claim 1 in which the wells are equipped to provide separate conduits that open into, respectively, upper and lower portions of the leached zone.

3. The process of claim 1 in which the permeability of the leached zone is increased by explosive fracturing.

4. The process of claim 1 in which the wells employed include at least a plurality of injection wells.

5. The process of claim 1 in which the hot aqueous fluid injected into the initial production location is a substantially gas-free liquid.

6. The process of claim 1 in which the flow path between at least a pair of wells is reversed by injecting steam through the well initially employed for fluid production and producing fluid through the well initially employed for steam injection.

* * * * *